United States Patent [19]

Mitchell et al.

[11] 4,012,031

[45] Mar. 15, 1977

[54] LOCK VALVE FLOW CONTROL ARRANGEMENT

[75] Inventors: Larry D. Mitchell, Ballwin; Edward M. Mason, St. Louis, both of Mo.

[73] Assignee: Affiliated Hospital Products, Inc., St. Louis, Mo.

[22] Filed: Mar. 25, 1975

[21] Appl. No.: 561,885

[52] U.S. Cl. ..... 269/325; 91/420; 91/447

[51] Int. Cl.[2] ..... A61G 13/00; F15B 13/042

[58] Field of Search ..... 269/325; 137/87, 106, 137/504; 91/420, 447

[56] References Cited

UNITED STATES PATENTS

| | | | |
|---|---|---|---|
| 2,845,086 | 7/1958 | Waterman et al. | 137/504 |
| 3,041,120 | 6/1962 | Burzlaff et al. | 269/325 |
| 3,072,107 | 1/1963 | Cassell | 91/447 X |
| 3,207,177 | 9/1965 | Nevulis | 91/420 X |
| 3,285,282 | 11/1966 | Martin | 137/504 X |
| 3,302,922 | 2/1967 | Gregor et al. | 91/420 X |
| 3,319,648 | 5/1967 | Donner | 137/504 |
| 3,576,192 | 4/1971 | Wood et al. | 91/420 X |
| 3,728,941 | 4/1973 | Cryder | 137/504 X |
| 3,818,936 | 6/1974 | Jackoboice et al. | 91/420 X |
| 3,857,404 | 12/1974 | Johnson | 91/420 X |

*Primary Examiner*—Irwin C. Cohen
*Attorney, Agent, or Firm*—Koenig, Senniger, Powers and Leavitt

[57] ABSTRACT

A unitary pilot-operated bi-directional cylinder lock valve and pressure-compensated flow control valve arrangement, having a common housing with internal porting connecting a pair of oppositely acting normally closed check valves operated to open by fluid pressure in one direction thereagainst on the inlet side and by a common free-floating inlet-pressure-responsive pilot piston therebetween. Also in the common housing and ported in line with each of the check valves are two pressure-compensated flow control valves which restrict fluid flow through the check valves as a function of flow pressure. The pressure-compensated flow control valves are also oppositely acting and each senses and acts to reduce fluid flow in response to pressure build-up in an opposite direction from that of the other. The unitary lock valve and pressure-compensated flow control valve is connected in line with one or more hydraulic cylinders of an operating table or other hydraulic cylinder-operated apparatus, with the exit/entrance ports from the pressure-compensated flow control valves connected to the opposite ends of the hydraulic cylinder or cylinders.

4 Claims, 4 Drawing Figures

LOCK VALVE FLOW CONTROL ARRANGEMENT

This invention relates to a unitary pilot-operated bi-directional cylinder lock valve and pressure-compensated flow control valve arrangement.

It is desirable to actuate hydraulic cylinders such that they will be actuated directly by and respond only to input pressure from a supply source but will be prevented from moving under solely external pressure exerted on the cylinder, and such that variations in applied fluid pressure will be compensated by inverse flow restriction so as to alleviate abrupt cylinder movement from such fluid pressure variations. Such is of particular value in such sensitive use applications as operating tables and the like. It is also highly desirable that such arrangement be small and compact.

It is accordingly a feature of the invention to provide a unitary pilot-operated bi-directional cylinder lock valve and bi-directional pressure-compensated flow control valve which is compact and is readily incorporated and used in an operating table or the like.

It is a further feature to provide an operating table or the like incorporating one or more of such unitary pilot-operated cylinder lock valve and pressure-compensated valve arrangement in series with a respective actuating cylinder or cylinders of the operating table.

Still other objects, features and attendant advantages of the invention will become apparent to one skilled in the art from a reading of the following detailed description of a preferred physical embodiment constructed in accordance with the invention, taken in conjunction with the accompanying drawings, wherein.

Figure 1:
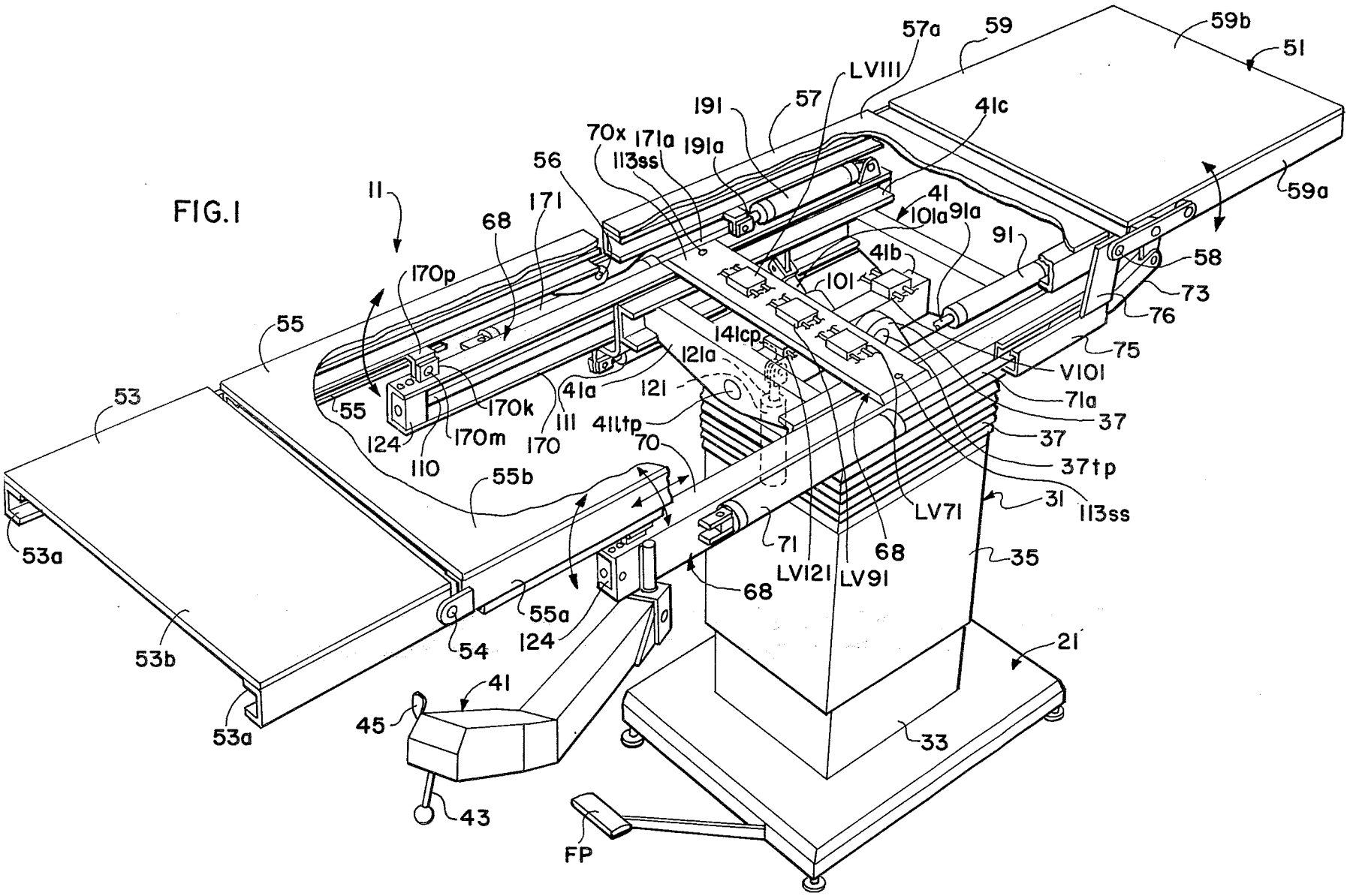
FIG. 1 is a perspective view of an operating table in which the invention may be utilized to advantage, the table being partially cut away as an aid to clarity and ease of description and understanding.

Referring now in detail to the Figures of the drawings, the invention is illustrated as applied to and embodied in an operating table 11 having a top 51 which is longitudinally slidably supported on a vertically adjustable pedestal 31 and base 21. The table top 51 has separate patient support sections 53, 55, 57, 59, which are pivotally secured together as by pivot pins 54, 56, 58, and the top is supported on the pedestal through pivot connections 58 and 170*m*, connecting between sections 53, 55 and a pair of slide frame U-channel support members 70, 170 which, together with transverse spreader plate 70*x*, form a slide frame 68 for slidably supporting the table top 51.

Table top 51 patient support sections 53, 55, 57, 59 are respectively indicated as head, back, seat and leg sections for ease and conventionality of designation, although it will be appreciated that such sections may support other portions of a patient's anatomy, or any given section may support all or a portion of a patient. These pivotally interconnected top sections 53, 55, 57, 59 are selectively articulatable about their respective interconnecting pivots 54, 56, 58, sections 55, 57, 59 being pivotally articulated by actuation of hydraulic cylinders 91, 191 and 71, 171, and head section 53 being manually selectively settably adjustable about pivot 54 relative to back section 55 as by suitable conventional or other desired mechanical means, not shown.

In addition, the entire table top 51 may be laterally tilted by actuation of hydraulic tilt cylinder 101, which with its piston rod 101*a* is suitably connected between the upper vertical support portion 37 of the pedestal 31 and a tilt frame 41 which is laterally tiltably mounted through tilt pivot pin or pins 41-1*tp* carried by a longitudinal pivot beam 41*b* which in turn is mounted for forwardly and rearwardly angular movement about a horizontal axis pivot support pin 37*tp* connecting with and carried by main pivot support block 37. Support block 37 forms the height-adjustable effective upper main support end of vertically adjustable pedestal 31. The tilt frame 41 is formed by longitudinal tilt beam 41*b* which is pivotally connected through pivot pin or pins 41-1*tp* to two lateral beams 41*a*, the ends of which are secured, as by welding, to U-channels 41*c*, which connect through slide connections to a slide shaft 110 secured at its opposite ends to slide frame parallel U-channel support members 70, 170 on which the top 51 is articulatably mounted.

Trendelenberg forward and rearward pivotal movement of the table top 51 about the transversely extending horizontal pivot axis formed by pivot pin 375*p* is effected by a Trendelenberg hydraulic cylinder 121 and rod 121*a* pivotally interconnecting between longitudinal pivot beam 41*b* and the pedestal upper main support block 37 or a suitable part fixedly secured thereto.

Sliding movement of the top 51 may be suitably effected by actuation of a slide hydraulic cylinder 111 which, with its rod 111*a*, extends and connects between a connection point on the underside of one of the U-channel support 170 of slide frame 68 and a connection point on the underside of tilt frame U-channel 41*c*.

Leg section 59 may be selectively pivoted about pivot 58 through hydraulic pressure actuation of paired leg cylinders 71, 171, which are connected between the respective slide frame U-channel support members 70, 170 and the leg section 59 through their respective piston rods 71*a*, 171*a* and links 73, 173 the pivot connection of the free ends of rods 71*a*, 171*a* with links 73, 173 being guided by channel buides 75.

Flexing of the seat and back sections 57, 55 may be effected through paired flex hydraulic cylinders 91, 191 which, with their rods 91*a*, 191*a*, connect between seat section 57 and slide frame U-channel supports 70, 170, through suitable opposite end pivot connections. A suitable pivot/slide motion support arrangement for the back section 55 pivot support 170*m* may be provided in order to accommodate the pivotal and sliding movement required by back section 55 during flexing of sections 57 and 55 by cylinders 91, 191. This may suitably take the form of pivot connections on each of U-channels 70, 170, and being indicated for illustration on one side at 170*k*, 170*m*, 170*p*, with pivoted inverted L-shaped slide member 170*p* slidably supportingly engaged in a channel guide 55*b* secured to its respective side frame U-channel 55*a* of back section 55.

Sliding of the table top 51 and the various articulations of the table top sections 53, 55, 57, 59, individually or collectively, are generally referred to herein as table top functions, and may be effected through actuation of the various hydraulic cylinders 71, 171, 91, 191, 101, 111, and 121, as discussed above.

The various table top articulation cylinders 71, 171, 91, 191, 101, 111, 121 may be suitably controlled from a swingably adjustably mounted hydraulic control console generally indicated at 41, having a table top function control handle or lever 43 and an elevate control handle or lever 45, which latter control handle 45 may be employed to control elevate actuation of an elevate hydraulic cylinder 131 in the pedestal 31 to effect height adjustment of the table top 51 through height adjustment of pedestal upper main support block 37 carried by vertical piston rod 131*a* of elevate cylinder 131.

In order to provide minimum x-ray interference beneath the patient support top sections, the slide frame 68 is formed by two laterally spaced parallel longitudinally extending U-channel members 70, 170, which are connected desirably solely by a transverse spreader plate 70*x* which may be suitably secured thereto as by welding or other suitable securing means. Also, for ease of use in conjunction with x-ray photographic or image intensifier equipment, the various top sections 53, 55, 57, 59 are formed by spaced opposed parallel side U-channels 53*a*, 55*a*, 57*a*, 59*a*, to which are suitable secured top panels 53*b*, 55*b*, 57*b*, 59*b* formed of radio-translucent material such as Benelex composition board. The parallel side U-channels form a channel guide support for slidably inserting x-ray film casettes, which may thereby be slidably removably supported beneath any desired section or sections of the table top radio-translucent panels 53*b*, 55*b*, 57*b*, 59*b*.

The slide frame 68 has slide shafts 110 disposed within each of the channels formed by U-channel members 70 and 170, the slide shafts 110 being secured in place by shaft mounting blocks 124, which in turn are adjustably secured to the opposite ends of the U-channels 70, 170, as through the medium of securing screws or bolts for desired parallel positioning of the slide shafts 110 of slide frame 68 slidably ride in low friction slide bushings such as linear ball bushings (not shown) secured at spaced positions on the laterally outer walls of tilt frame U-channel members 41*c*, thereby enabling sliding movement of the slide frame 68 and the table top 51 carried thereby.

In order to prevent inadvertent reverse bleeding of liquid from the table top function cylinders 71/171, 91,191, 101, 111, 121 through the control valves 211, 221, etc. and back to tank reservoir R as a result of external load on the top 51 and a given cylinder or cylinders, and to minimize abrupt acceleration or deceleration of the table top function cylinder operations due to supply-and/or external load-induced cylinder pressure variations, a unique pressure-compensated pilot-operated lock valve unit LV71, LV91, LV101, LV111, and LV121 is interposed in the supply/return lines between each table top function valve (e.g. tilt control valve 211 of the hydraulic control valve unit 41) and its associated table top function hydraulic cylinder (e.g. tilt cylinder 101). Each of these lock valves LV71, LV91, LV101, Lv111, and Lv121 is formed as a compact totally enclosed block unit having four simple external line connections INA, INB, OA, and OB and two thru-mounting holes MH extending through the one-piece valve housing or block 300. These compact lock valves may be easily and conveniently mounted on the support structure beneath the table top 51, as shown in FIGS. 1 and 2, the lock valves LV71, LV91 and LV111 being simply and easily accessibly mounted, as by bolts or screws, on the top of transverse spreader plate 70*x*, and the lock valves LV101 and LV121 being mounted on longitudinal tilt beam 41*b* for ease of access and ease of line connections to the associated table top function cylinders.

It is not necessary to utilize the special lock valve arrangement for the elevate cylinder 131, as a conventional simple selectively mechanically relieved return flow blocking check valve, relieved as by a push rod selectively moved by the foot pedal FP at the extreme bottom of its travel, may be employed between the elevate cylinder and the tank reservoir to enable lowering movement, with a simple up-pressure flow control valve for elevate operation thereof, and the normally large volume of the elevate cylinder will itself smooth out any elevation movements resulting from abrupt changes in elevate supply liquid pressure.

Figure 2:
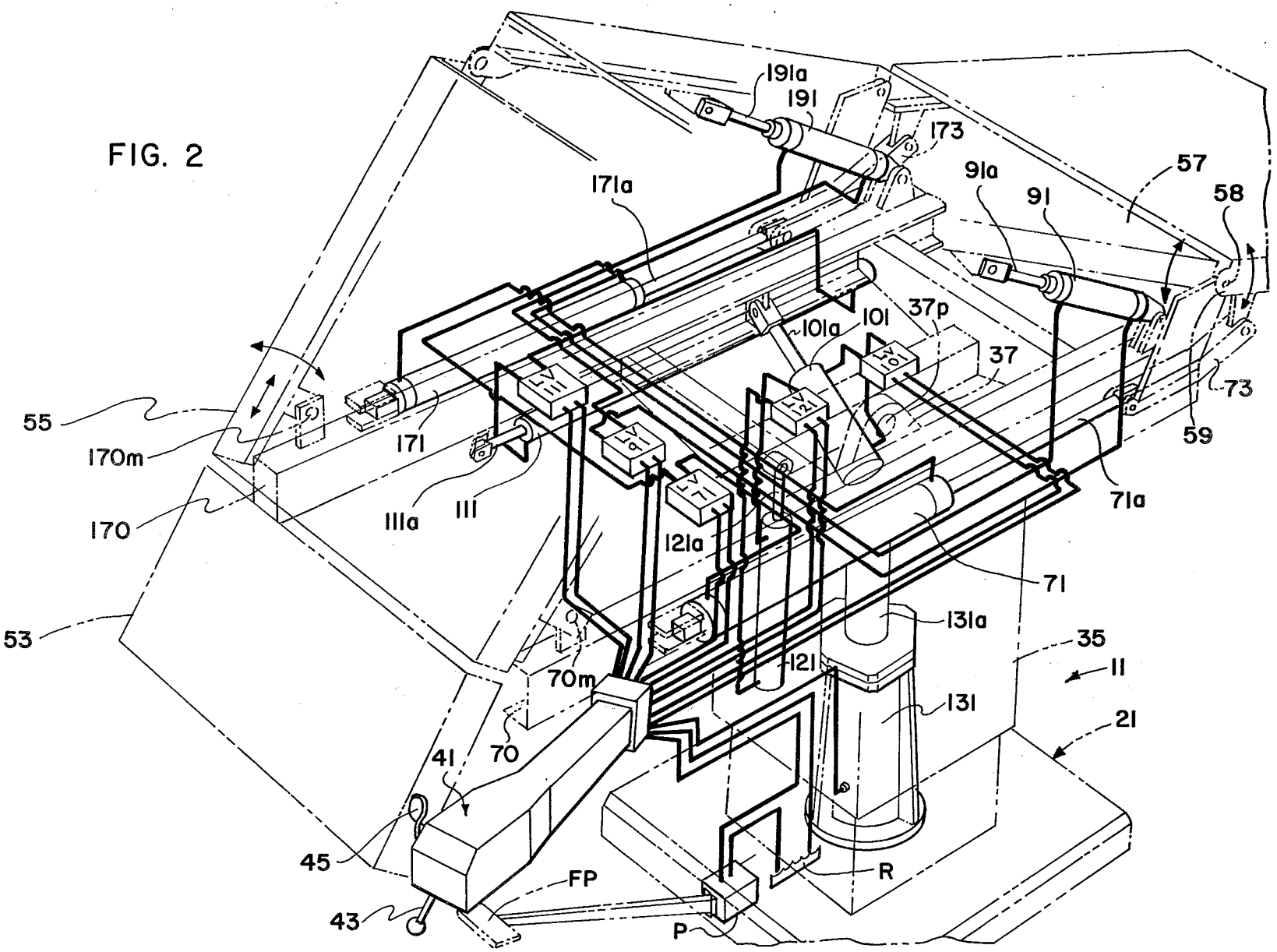
FIG. 2 is a schematic illustration of the application of the invention to the operating table of FIG. 1, the major structure of the operating table being shown in phantom, with the hydraulic circuitry shown in exaggerated solid lines for ease and clarity of illustration.
Figure 3:
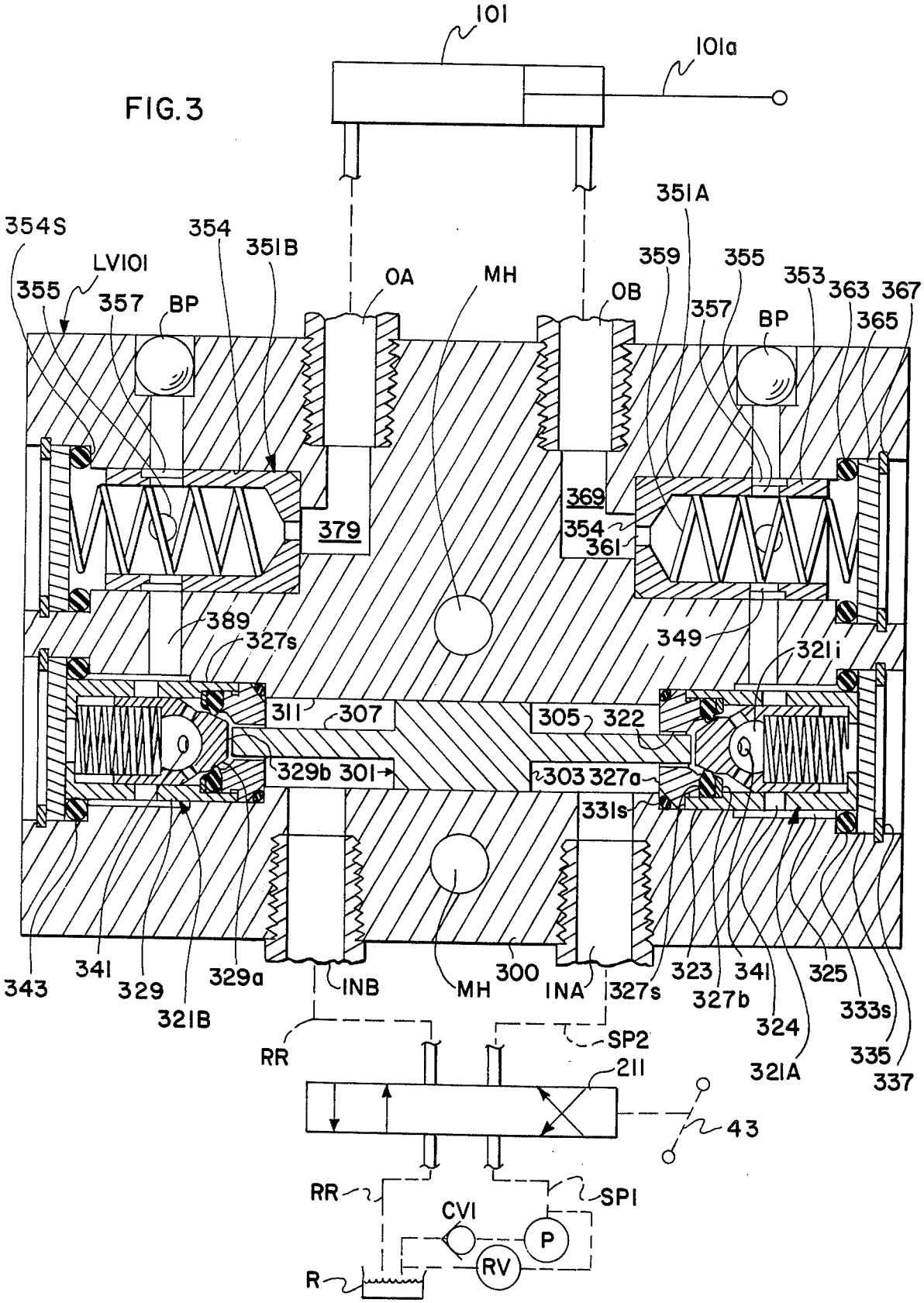
FIG. 3 is an illustration, partly in section and partly schematic, illustrating the pilot-operated cylinder lock valve and pressure-compensated flow control valve arrangement of the invention, as employed in the operating table of FIGS. 1 and 2, the apparatus being shown in the condition with zero fluid supply pressure to the lock valve arrangement.
Figure 4:
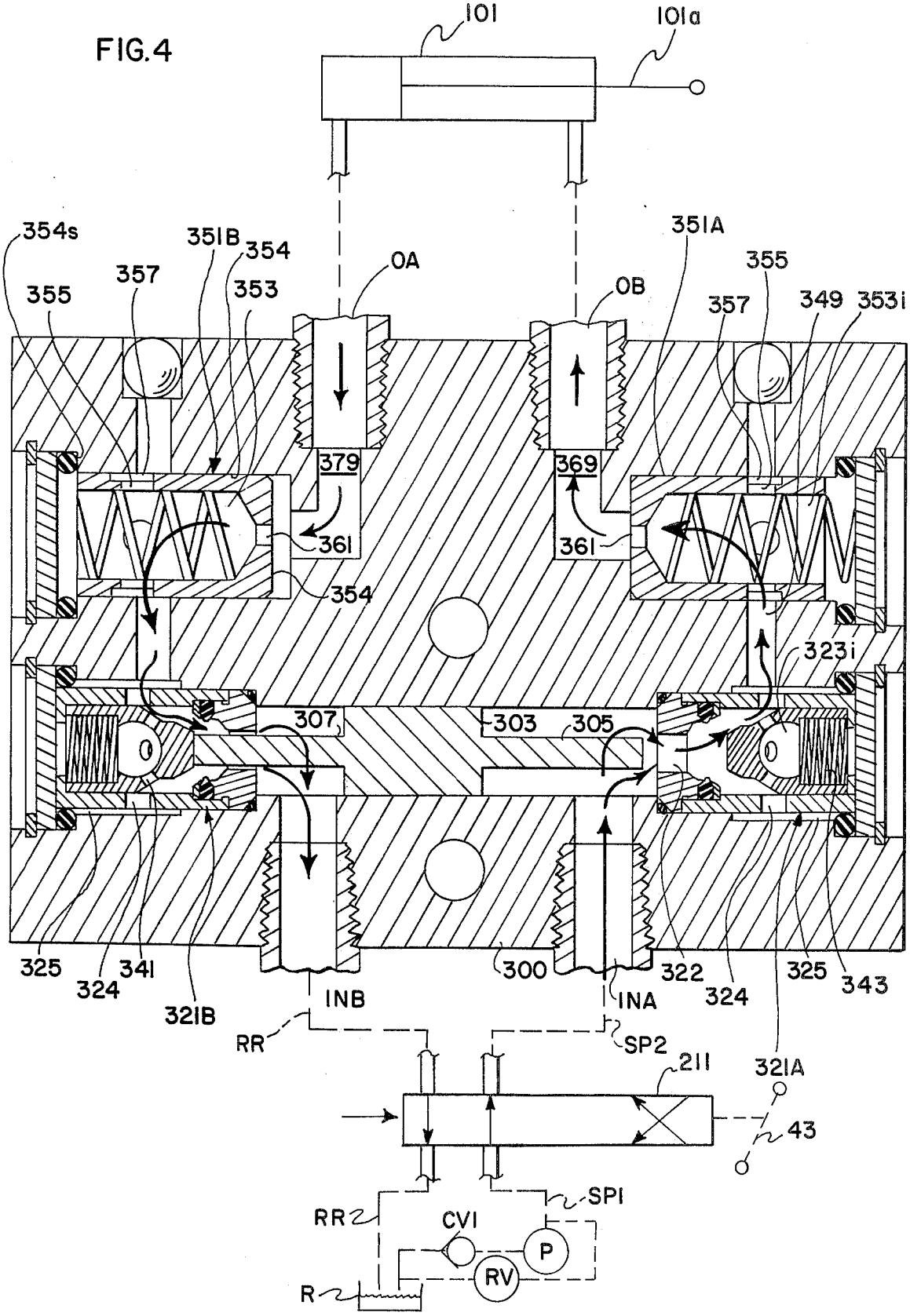
FIG. 4 is a view and illustration similar to that of FIG. 3, with fluid supply pressure applied to the lock valve in one direction, and with liquid flow through the system in that direction.

Referring now in further detail to FIGS. 3 and 4, a lock valve arrangement according to the invention is illustrated in conjunction with the tilt cylinder 101 of the operating table of FIGS. 1 and 2. It will be appreciated that each of the other lock valves LV71, LV91, LV111 and LV121 may be similarly arranged with respect to their associated table top function cylinder or cylinders. Accordingly, only a single illustrative flow controlled actuating assembly is shown by way of FIGS. 3 and 4. The lock valve LV101 is arranged in fluid flow control relation between the selective control valve 211 and the tilt cylinder 101, through hydraulic line connections connecting with the respective ports INA, INB, OA, and OB. The ports INA and INB are designated as inlet ports for convenience, although flow may occur therethrough in both directions, as will be later noted, and similarly ports OA and OB are designated as outlet ports, although likewise fluid may flow through each of these ports in opposite directions, as will be later discussed. The designation of these ports in this fashion is utilized to indicate the input or supply pressure application through the respective ports INA and INB, this being the only manner in which the liquid is permitted to flow through the lock valve LV101, as will be later described.

Foot pump P is connected through supply pressure line SPI to the control valve 211, and pump P connects with the tank reservoir through a check valve CVI and a relief valve RV. A return reservoir line RR is connected between the control valve 211 and tank reservoir R.

The lock valve LV101 incorporates a housing 300 formed of a single integral block of metal or other suitable material, which may have thru mounting holes MH for mounting at selected positions on the support structure of the operating table 11 or other equipment used therewith, as discussed above.

Transverse stepped bores are formed in the housing block 300, within which are secured respectively oppositely acting check valves 321A, 321B, each of which is arranged to act to prevent reverse or out flow through the associated respective inlet port INA and INB in the normal unpressurized condition of ports INA and INB as shown in FIG. 3. Disposed in a central bore 311 extending between the two interfacing check valves 321A, 321B, is a double-acting pressure-responsive pilot-actuated piston 301. Each of the check valves 321A is identical, and accordingly identical reference numerals are utilized for the parts of both of these check valves 321, with the exception of the over-all general designation thereof as 321A and 321B.

Each of the check valves 321A, 321B is provided with a piston 329 slidable in a cylindrical bore formed in the check valve housing 323. Check valve pistons 329 are resiliently biased to closed condition in contact with their respective o-ring seals 327*s* at the nose end tapered seat face 329*a* thereof, as by a light compression spring 343. O-ring seal 327*s* may be suitably secured in place through the medium of retention ring members 327*b* and 327*a*, the o-ring seal 327*s* being laterally squeezed between, and extending radially inwardly into the ring opening in, these two ring members to form the annular seat for engagement with the tapered seat face 329*a* of the piston 329. End plug ring member 327*a* has an exit/entrance and bore 322 formed therein, and may be press-fit or staked in place in the end of the housing 323. An o-ring seal 331*s* is disposed between an annular chamfer on the retention plug ring 327*a* and the shouldered bore within which the respective check valve 321A, 321B is inserted, to thereby effect a fluid seal in this zone. The check valves 321A, 321B are secured in their respective end bores in the block 300, through the medium of a cap seal 335, and o-ring seal 333*s* and a retention snap ring 337.

Fluid communication through each respective check valve 321A, and 321B is enabled through the exit/entrance bore 322, and passage past the o-ring seal 327*s* and tapered seat face 329*a*, past the tapered end of piston 329, and through a plurality of radial bores or holes 324 formed in the housing 323, there being an annular step groove 325, as by a counterbore in the block 300, about the annular exterior of the check valve housing 323 in the vicinity of port holes 324, which annular groove 325 connects with a bore 349 adjoining check valve 321A, and a bore 389 adjoining check valve 321B, to thereby enable fluid flow through the respective check valve upon opening of the valve as a function of positive pressure in the respective inlet port INA, INB or through the mechanical pushing action on the nose end 329*b* of the piston 329 by the double-acting pilot piston 301 as a function of positive inlet pressure from pump P at the opposite INB or INA port from the particular valve 321A, 321B. Bores 341 in piston 329 enable pressure relief between the interior and exterior of hollow piston 329.

The double-acting pressure-responsively slidable actuator piston 301 has two oppositely extending stems 305, 307 which, in the neutral position of piston 301, extend into each of the exit/entrance bores 322 of the respective check valves 321A, 321B, the stems 305, 307 being substantially diametrally undersized with respect to the bores 322, so as to enable ease of fluid passage through a bore 322 while the respective stem is disposed therein. The piston 301 also has a pressure-responsive actuating face 303 against which the pressure in the respective bore INA or INB acts to effect sliding movement of the piston 301 to open the opposite side check valve 321A or 321B, as the case may be. In operation, as shown in FIG. 4, it will be seen that the application of positive fluid pressure from pump P to either of the inlet ports INA, INB will result in fluid pressure actuated displacement of the respective check valve piston 329 away from its o-ring seat 327*s*, to thereby open the valve, and will also effect sliding movement of the pilot-operated piston 301 in the opposite direction to mechanically unseat the opposite piston 329 and open the other check valve, thereby enabling liquid passage through both valves 321A, 321B under this condition. Under all other pressure conditions, the two valves 321A, 321B will be closed, as shown in FIG. 3, as a function of the spring pressure exerted by springs 343 which act to move the pistons 329 into seated sealing engagement with their respective o-ring seals 327*s*.

While other check valves or check valve constructions may be utilized in practice of the broad invention, the illustrated embodiment is preferred in view of its very good reverse of check flow sealing ability, its compact size and ease of functional and structural accomodation and operation in the overall arrangement, and its ease of drop-in insert assembly in and removal from the valve unit block 300.

Bores 349 and 389 may be suitably formed to the desired depth in block 300 and sealed at their outer end by press-fit ball plugs BP, for ease of construction. The outer end portion of the bores is only a result of this mode of construction and serves no further purpose or function.

Pressure responsive flow control valves 351A, 351B are each identical and disposed in opposite pressure responsive relation. Each valve 351A, 351B includes a slidable hollow flow control piston 353 resiliently biased toward its face end 354 by a compression spring 359 acting between the face end 354 and a cap seal 365. Cap seal 365 and o-ring seal 363 are seated against a counterbore annular shoulder 354*s* concentric with the cylindrical bore 354 within which piston 353 slides. A snap ring 367 secures the drop-in piston and seal assembly 353, 359, 363, 365 in place and enables ease of assembly, as well as dis-assembly as may be required for servicing.

Piston 353 has an annular groove 357 and circumferentially spaced radial port holes 355 formed in its wall directly and fully adjoining and in full fluid flow registry with bores 349, 389 in the seated position of the piston 353, as shown in FIG. 5A, thereby permitting full flow through the bores 349, 389 to the full extent permitted by the size of the various passageways in the system.

The piston end face 354 has value central bore 361, smaller than the adjacent diameter of the respective bore 369, 379, whereby a pressure differential may be created between the exterior end face and the hollow interior of piston 353 during flow in the direction acting against spring 359. A pressure differential will, of course, also appear in the opposite flow direction, but will have no control effect, the pressure differential across bore 361 being effective to enable control on only the one valve 351A or 351B in which the fluid pressure is acting against the spring 359. For either of the valves 351A, 351B under this condition, the piston 353 will be slidably moved against the action of spring 359, thereby reducing the effective fluid passageway formed at the intersection of annular groove 357 and the particular connecting bore 349 or 389. This will reduce the flow rate until the spring 359 and the net fluid pressure acting against spring 359 are in equilibrium, and this pressure compensated flow control action will continue during the time that check valves 321A, 321B are open in the manner as previously discussed. The net result is to provide both a positive fluid flow shut-off control preventing fluid flow from the table top function cylinder 101 when the valve 211 is closed, independent of load variations, and to provide a pressure compensated smoothing of the flow rate of the liquid to and from the cylinder 101 during desired positive supply of fluid pressure thereto from pump P.

While the invention has been illustrated and described with respect to a particular illustrative and preferred embodiment, it will be apparent that various modifications and improvements may be made without departing from the scope and spirit of the invention. Accordingly the invention is not to be limited by the particular illustrative embodiment, but only by the scope of the appended claims.

We claim:

1. In combination, an operating table having a top for supporting a patient, means for adjusting the top for variably positioning the patient including at least one double-acting hydraulic cylinder, a reservoir for hydraulic fluid, a foot pedal operated hydraulic pump having an inlet receiving fluid from the reservoir and an outlet for delivery of fluid under pressure on operation of the pedal, a control valve having an inlet receiving fluid from the pump outlet, an outlet for returning fluid to the reservoir, and first and second transfer ports, said control valve being adapted to be set in a closed position blocking the transfer ports, a first open position for delivery of fluid under pressure through said first port and venting of the second port to the reservoir and in a second open position for delivery of fluid under pressure through said second port and venting of said first port to the reservoir, and flow control means in the system between said control valve and said cylinder comprising means providing a first passage interconnecting said first port and one end of said cylinder and a second passage interconnecting said second port and the other end of the cylinder, a first check valve in the first passage arranged to open in response to setting of the control valve in its said first open position and operation of the pump for delivery of fluid under pressure to said one end of the cylinder, a second check valve in the second passage arranged to open in response to setting of the control valve in its second position and operation of the pump for delivery of fluid under pressure to said other end of the cylinder, means responsive to delivery of fluid under pressure to the first check valve to open the second check valve and responsive to delivery of fluid under pressure to the second check valve to open the first check valve, first pressure responsive flow regulating means in said first passage between the first check valve and said one end of the cylinder responsive solely to pressure from said one end of the cylinder to effect flow regulation for effecting relatively smooth flow of fluid from said one end of the cylinder to the reservoir when said control valve is set in its second position, and second pressure responsive flow regulating means in said second passage between the second check valve and said other end of the cylinder responsive solely to pressure from said other end of the cylinder of effect flow regulation for effecting relatively smooth flow of fluid from said other end of the cylinder to the reservoir when said control valve is set in its first position.

2. In a hydraulic system as set forth in claim 1, said means providing said passages comprising a valve body having a first bore therein, with said check valves at opposite ends of said bore and adapted to open in the directions away from the opposite ends of said bore, each check valve having spring means biasing it closed in the direction toward its respective end of said bore, said means for opening said check valves comprising a piston slidable in said bore, said first passage including a connection between said first port and said bore between one end of the piston and said first check valve, and said second passage including a connection between said second port and said bore between the other end of the piston and said second check valve.

3. In a hydraulic system as set forth in claim 2, said first and second flow regulating means each comprising means for restricting flow in its respective passage.

4. In a hydraulic system as set forth in claim 3, said first restriction means comprising a first flow control piston slidable in a second bore in the valve body, said first passage including a connection between said second bore and said one end of the cylinder and a connection between the second bore and said first bore, and said second restriction means comprising a second flow control piston slidable in a third bore in the valve body generally opposite said second bore, said second passage including a connection between said third bore and said other end of the cylinder and a connection between the third bore and said first bore, said pistons being slidable between an open position and a flow restricting position and being spring biased toward the former.

* * * * *